US011191355B2

(12) United States Patent
Wang et al.

(10) Patent No.: US 11,191,355 B2
(45) Date of Patent: Dec. 7, 2021

(54) WINE BOTTLE POSITIONING DEVICE AND WINE STORAGE APPARATUS

(71) Applicants: Wei-Jun Wang, Taipei (TW); Wen-Yi Chiu, Taipei (TW)

(72) Inventors: Wei-Jun Wang, Taipei (TW); Wen-Yi Chiu, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 0 days.

(21) Appl. No.: 16/589,164

(22) Filed: Oct. 1, 2019

(65) Prior Publication Data

US 2020/0121079 A1 Apr. 23, 2020

Related U.S. Application Data

(60) Provisional application No. 62/748,535, filed on Oct. 22, 2018.

(51) Int. Cl.
*A47B 73/00* (2006.01)
*A47B 97/00* (2006.01)

(52) U.S. Cl.
CPC ..... *A47B 73/004* (2013.01); *A47B 97/00* (2013.01)

(58) Field of Classification Search
CPC ..... A47F 7/285; A47F 7/283; A47B 73/004; A47B 73/006; A47B 97/00
See application file for complete search history.

(56) References Cited

U.S. PATENT DOCUMENTS 81,814 A * 9/1868 Nuellens et al. ..... F25D 31/007 62/297
592,781 A * 11/1897 Hertwig ..... A47G 23/0241 220/506
2,338,310 A * 1/1944 Barnes ..... A47B 73/00 211/74
3,500,649 A * 3/1970 Feldman ..... F25B 21/02 62/3.6
3,941,237 A * 3/1976 MacGregor, Jr. ..... B08B 9/28 198/867.13
3,964,708 A * 6/1976 Reeves ..... A45D 20/00 248/126
4,299,100 A * 11/1981 Crisman ..... B65D 81/3883 220/592.17

(Continued)

FOREIGN PATENT DOCUMENTS

CN 2923539 7/2007
CN 203268628 11/2013

(Continued)

OTHER PUBLICATIONS

"Office Action of China Counterpart Application", dated Mar. 16, 2021, p. 1-p. 13.

(Continued)

*Primary Examiner* — Stanton L Krycinski
(74) *Attorney, Agent, or Firm* — JCIPRNET

(57) ABSTRACT

A wine bottle positioning device includes a sleeving component and a door cover. The sleeving component includes a positioning base and a positioning sleeve connected to the positioning base. The door cover is movably disposed at the positioning base. Another wine bottle positioning device is also provided. A wine storage apparatus is also provided.

33 Claims, 13 Drawing Sheets

(56) References Cited

U.S. PATENT DOCUMENTS

| | | | | | |
|---|---|---|---|---|---|
| 4,531,381 | A * | 7/1985 | Toro | B65D 81/3834 | 62/372 |
| 4,534,391 | A * | 8/1985 | Ventimiglia | A47G 23/0266 | 220/739 |
| 4,870,837 | A * | 10/1989 | Weins | B65D 81/3883 | 62/457.4 |
| 5,862,937 | A * | 1/1999 | Carrizales | F25D 31/007 | 220/501 |
| 5,957,313 | A * | 9/1999 | Bouan | B65D 50/06 | 215/215 |
| 6,047,837 | A * | 4/2000 | Kessens | A47F 7/283 | 211/181.1 |
| 6,082,114 | A * | 7/2000 | Leonoff | A47J 31/005 | 62/3.64 |
| 6,168,043 | B1 * | 1/2001 | Yen | A47G 23/0241 | 220/501 |
| 6,230,905 | B1 * | 5/2001 | Camblor | A47B 73/004 | 211/74 |
| 6,330,808 | B1 * | 12/2001 | Kouwenberg | F25D 31/007 | 62/372 |
| 6,435,355 | B1 * | 8/2002 | Brown | A47B 73/006 | 211/44 |
| 6,502,711 | B1 * | 1/2003 | Mc Rae | B65D 21/0204 | 211/71.01 |
| 6,705,110 | B1 * | 3/2004 | Worsham | F25D 31/007 | 62/371 |
| 7,004,336 | B2 * | 2/2006 | Dagan | A47B 73/006 | 211/181.1 |
| 7,004,340 | B2 * | 2/2006 | Belden, Jr. | B65D 55/14 | 215/215 |
| 7,007,523 | B2 * | 3/2006 | Belden, Jr. | B65D 55/14 | 206/1.5 |
| 7,131,544 | B1 * | 11/2006 | Cunningham | A47B 73/006 | 211/74 |
| 7,614,516 | B2 * | 11/2009 | Beggins | B65D 81/3879 | 215/386 |
| 7,784,759 | B2 * | 8/2010 | Farrell | B65D 81/3879 | 248/315 |
| 8,267,259 | B2 * | 9/2012 | Fisher | A47B 73/004 | 211/75 |
| 8,534,345 | B1 * | 9/2013 | French | A47J 41/00 | 165/10 |
| 9,133,006 | B2 * | 9/2015 | Kelley | B67C 7/00 | |
| 9,555,949 | B1 * | 1/2017 | French | A47J 41/00 | |
| 10,098,454 | B2 * | 10/2018 | Hsieh | A47B 96/027 | |
| 10,178,908 | B1 * | 1/2019 | Tseng | A47B 47/0091 | |
| 10,561,238 | B1 * | 2/2020 | Gutierrez | A47B 73/006 | |
| 2007/0090256 | A1 * | 4/2007 | Hansen | B60N 3/101 | 248/311.2 |
| 2007/0191983 | A1 * | 8/2007 | Griffits | G07F 9/02 | 700/213 |
| 2010/0132831 | A1 | 6/2010 | Waroux et al. | | |
| 2016/0309891 | A1 * | 10/2016 | van Leeuwen | A47B 73/006 | |
| 2017/0367479 | A1 * | 12/2017 | Hsieh | A47F 7/283 | |

FOREIGN PATENT DOCUMENTS

| | | |
|---|---|---|
| CN | 203388512 | 1/2014 |
| CN | 108454444 | 8/2018 |
| TW | 311596 | 7/1997 |
| TW | M398386 | 2/2011 |
| TW | M506557 | 8/2015 |

OTHER PUBLICATIONS

"Office Action of Taiwan Counterpart Application", dated Jul. 10, 2020, p. 1-p. 6.

* cited by examiner

WINE BOTTLE POSITIONING DEVICE AND WINE STORAGE APPARATUS

CROSS-REFERENCE TO RELATED APPLICATION

This application claims the priority benefit of U.S. provisional application Ser. No. 62/748,535, filed on Oct. 22, 2018. The entirety of the above-mentioned patent application is hereby incorporated by reference herein and made a part of this specification.

BACKGROUND OF THE DISCLOSURE

1. Field of the Disclosure

The present disclosure relates to a positioning device and a wine storage apparatus, and in particular, to a wine bottle positioning device and a wine storage apparatus using the wine bottle positioning device.

2. Description of Related Art

For vintners or alcoholic drink lovers, storage and management of alcoholic drinks can be classified and recorded according to categories, vintages, brands (or wineries), prices, countries, regions, levels or the like of the alcoholic drink. Using wine as an example, to prevent wine from deteriorating, keep the moisture of the cork, and avoid damage of the wine bottle, not only wine needs to be stored in an environment away from light and with constant temperature and humidity and ventilation, but also the wine bottles need to lie flat, and be prevented from displacement or damage caused by vibration, shake or impact. Therefore, how to improve safety and reliability of wine storage and facilitate the management is currently an urgent problem to be resolved.

SUMMARY OF THE DISCLOSURE

The present disclosure provides a wine bottle positioning device and a wine storage apparatus to improve safety and reliability of wine storage.

An embodiment of the present disclosure provides a wine bottle positioning device which includes a sleeving component and a door cover. The sleeving component includes a positioning base and a positioning sleeve connected to the positioning base. The door cover is movably disposed at the positioning base.

In an embodiment of the present disclosure, the positioning base includes an opening and a first internal space communicated with the opening, and the positioning sleeve includes a second internal space communicated with the first internal space.

In an embodiment of the present disclosure, the door cover is located in the first internal space, the door cover includes a cover portion and a pivot portion connected to the cover portion. The cover portion is configured to open or close the opening, and the pivot portion is pivoted to the positioning base.

In an embodiment of the present disclosure, the wine bottle positioning device further includes a torsion spring sleeved on the pivot portion. The torsion spring includes a first end and a second end opposite to the first end. The first end abuts against the cover portion, and the second end abuts against the positioning base.

In an embodiment of the present disclosure, the door cover further includes a sensing portion connected to the cover portion.

In an embodiment of the present disclosure, the positioning base further includes an open groove communicated with the first internal space. The open groove is located on a moving path of the sensing portion.

In an embodiment of the present disclosure, the sensing portion is moved out of the first internal space through the open groove after the door cover is rotated relative to the positioning base to open the opening.

In an embodiment of the present disclosure, the positioning base further includes a first surface and a second surface intersecting the first surface. The opening is located at the first surface, and the open groove is located at the second surface.

In an embodiment of the present disclosure, the first internal space of the positioning base has a first depth axis, the second internal space of the positioning base has a second depth axis. An angle between the first depth axis and the second axis is ranged from 3 to 7 degrees.

Another embodiment of the present disclosure provides a wine bottle positioning device which includes a sleeving component and an auxiliary positioning sleeve. The sleeving component includes a positioning base and a positioning sleeve connected to the positioning base. The positioning base includes an opening and a first internal space communicated with the opening, and the positioning sleeve includes a second internal space communicated with the first internal space. The auxiliary positioning sleeve is disposed in the second internal space, and includes a third internal space. The third internal space is communicated with the first internal space.

In an embodiment of the present disclosure, the positioning sleeve further includes an inner wall surface surrounding the second internal space and a first positioning portion located on the inner wall surface.

In an embodiment of the present disclosure, the auxiliary positioning sleeve further includes an outer wall surface facing away from the third internal space and a second positioning portion located on the outer wall surface.

In an embodiment of the present disclosure, the outer all surface of the auxiliary positioning sleeve faces towards the inner wall surface of the positioning sleeve, and the second positioning portion is engaged with the first positioning portion.

In an embodiment of the present disclosure, the auxiliary positioning sleeve further includes an inner wall surface surrounding the third internal space and a plurality of positioning fin sets connected to the inner wall surface.

In an embodiment of the present disclosure, the positioning fin sets are arranged alternately along a depth axis of the third internal space.

In an embodiment of the present disclosure, each of the positioning fin sets includes at least two positioning fins.

In an embodiment of the present disclosure, each of the positioning fins includes a convex curved surface connected to the inner wall surface and a concave curved surface facing away from the convex curved surface, and the two concave curved surfaces of the two positioning fins define a positioning channel.

In an embodiment of the present disclosure, the auxiliary positioning sleeve further includes an inner wall surface surrounding the third internal space and a plurality of positioning fins connected to the inner wall surface.

In an embodiment of the present disclosure, the positioning fins are arranged alternately around a depth axis of the third internal space.

In an embodiment of the present disclosure, each of the positioning fins extends along a depth axis of the third internal space.

In an embodiment of the present disclosure, each of the positioning fins includes a positioning surface facing away from the third internal space, and the positioning surfaces of the positioning fins define a positioning channel.

In an embodiment of the present disclosure, each of the positioning fins further includes a first positioning end close to the opening and a second positioning end away from the opening.

In an embodiment of the present disclosure, a height of each positioning surface of each of the positioning fins gradually increases from the first positioning end to the second positioning end.

In an embodiment of the present disclosure, each of the positioning fins is in a spiral shape.

In an embodiment of the present disclosure, the auxiliary positioning sleeve further includes an inner wall surface surrounding the third internal space and a plurality of auxiliary fins connected to the inner wall surface.

In an embodiment of the present disclosure, any two of the auxiliary fins adjacent to each other is separated by one of the positioning fins.

In an embodiment of the present disclosure, each of the auxiliary fins includes an auxiliary surface facing away from the inner wall surface of the third internal space.

In an embodiment of the present disclosure, each of the auxiliary fins further includes a first auxiliary end close to the opening and a second auxiliary end away from the opening.

In an embodiment of the present disclosure, a height of the auxiliary surface of each of the auxiliary fins gradually increases from the first auxiliary end to the second auxiliary end.

In an embodiment of the present disclosure, a height of the positioning surface of each of the positioning fins on the first positioning end is greater than a height of the auxiliary surface of each of the auxiliary fins on the first auxiliary end.

In an embodiment of the present disclosure, a height of the positioning surface of each of the positioning fins on the second positioning end is greater than a height of the auxiliary surface of each of the auxiliary fins on the second auxiliary end.

In an embodiment of the present disclosure, the third internal space of the auxiliary positioning sleeve is divided into an upper half space and a lower half space, the auxiliary fins are distributed in the upper half space, and the positioning fins are distributed in the upper half space and the lower half space.

In an embodiment of the present disclosure, the second internal space of the positioning sleeve has a second depth axis, the third internal space of the auxiliary positioning sleeve has a third depth axis, and the second depth axis and the third depth axis are coaxial.

An embodiment of the present disclosure provides a wine storage apparatus which includes a shelf and a plurality of wine bottle positioning devices integrated on the shelf. Each of the wine bottle positioning devices includes a sleeving component. Each of the sleeving components includes a positioning base and a positioning sleeve connected to the positioning base and is configured to sheathe a bottleneck of an external wine bottle. The positioning base of each of the sleeving components includes an opening configured for inserting the bottleneck.

Based on the above, by inserting and positioning an external wine bottle in the wine bottle positioning device of the present disclosure, the external wine bottle can be ensured to lie flat, and further be prevented from displacement or damage caused by vibration, shake or impact, thereby improving safety and reliability of wine storage. On the other hand, the wine storage apparatus of the present disclosure using the wine bottle positioning device also improves the safety and reliability of wine storage.

To make the foregoing features and advantages of the present disclosure comprehensible, embodiments are described below in detail with reference to the accompanying drawings.

DESCRIPTION OF THE EMBODIMENTS

Figure 1A:
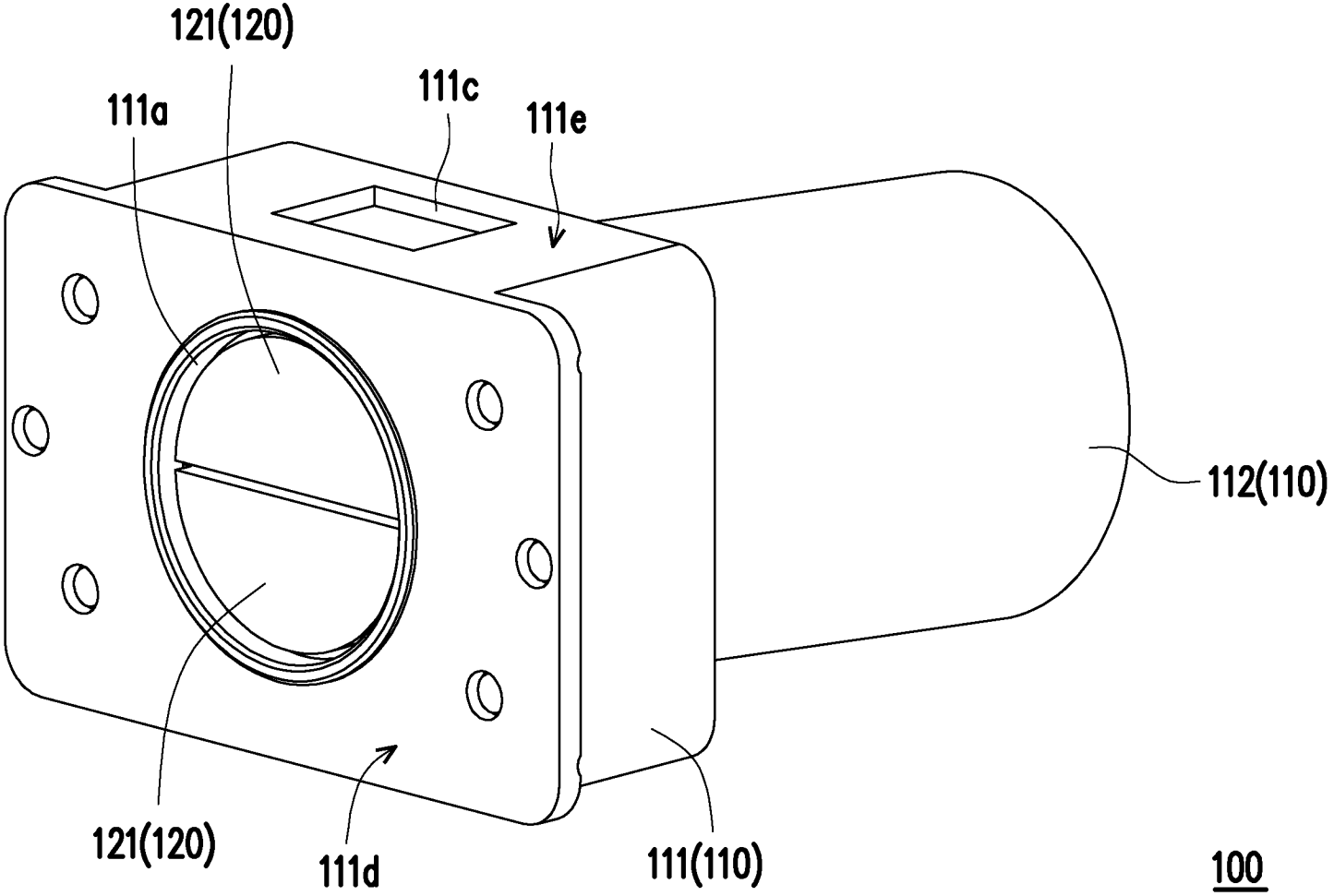
FIG. 1A and FIG. 1B are schematic diagrams of a wine bottle positioning device in a closed state and an open state according to a first embodiment of the present disclosure.
Figure 1B:
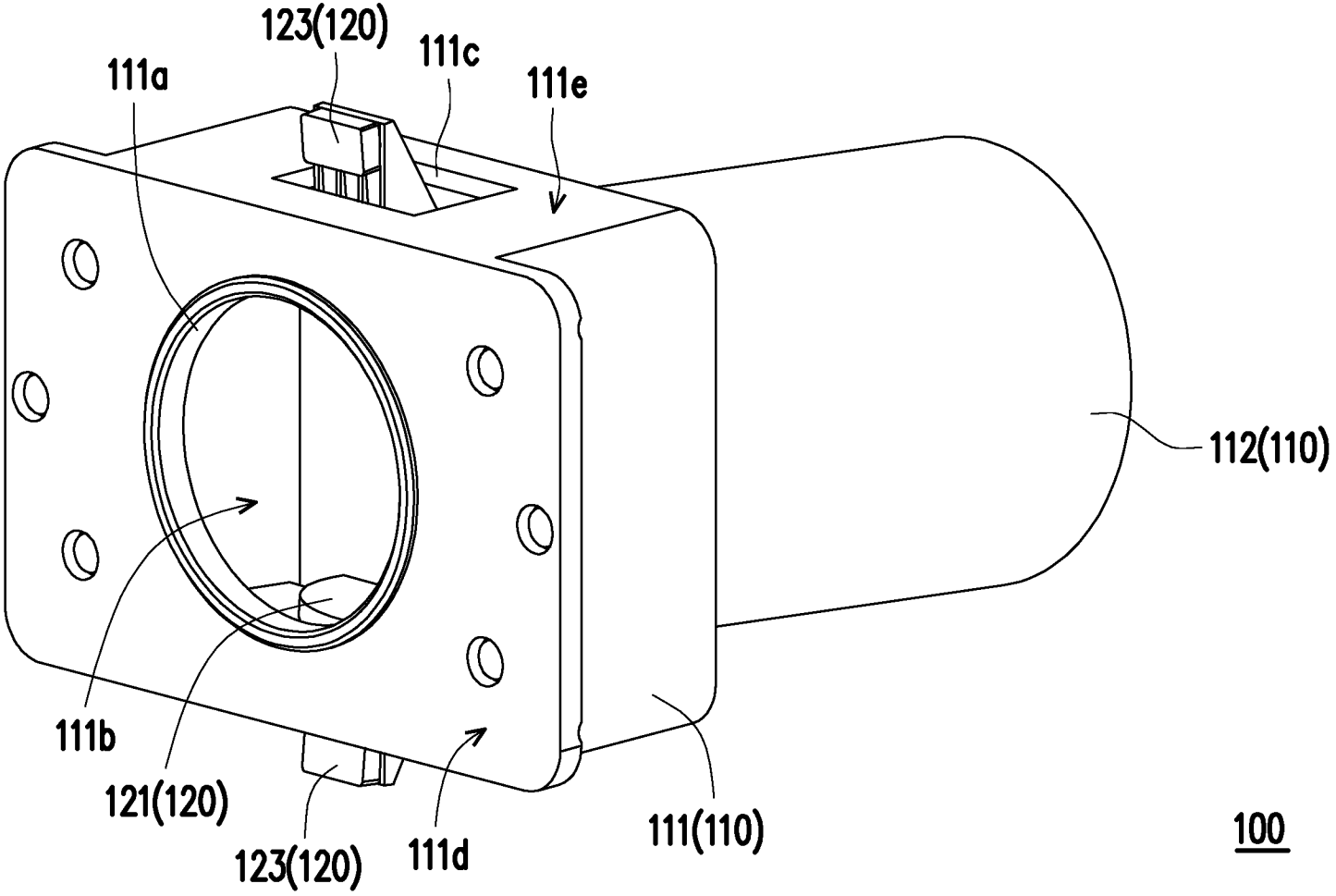
Figure 2A:
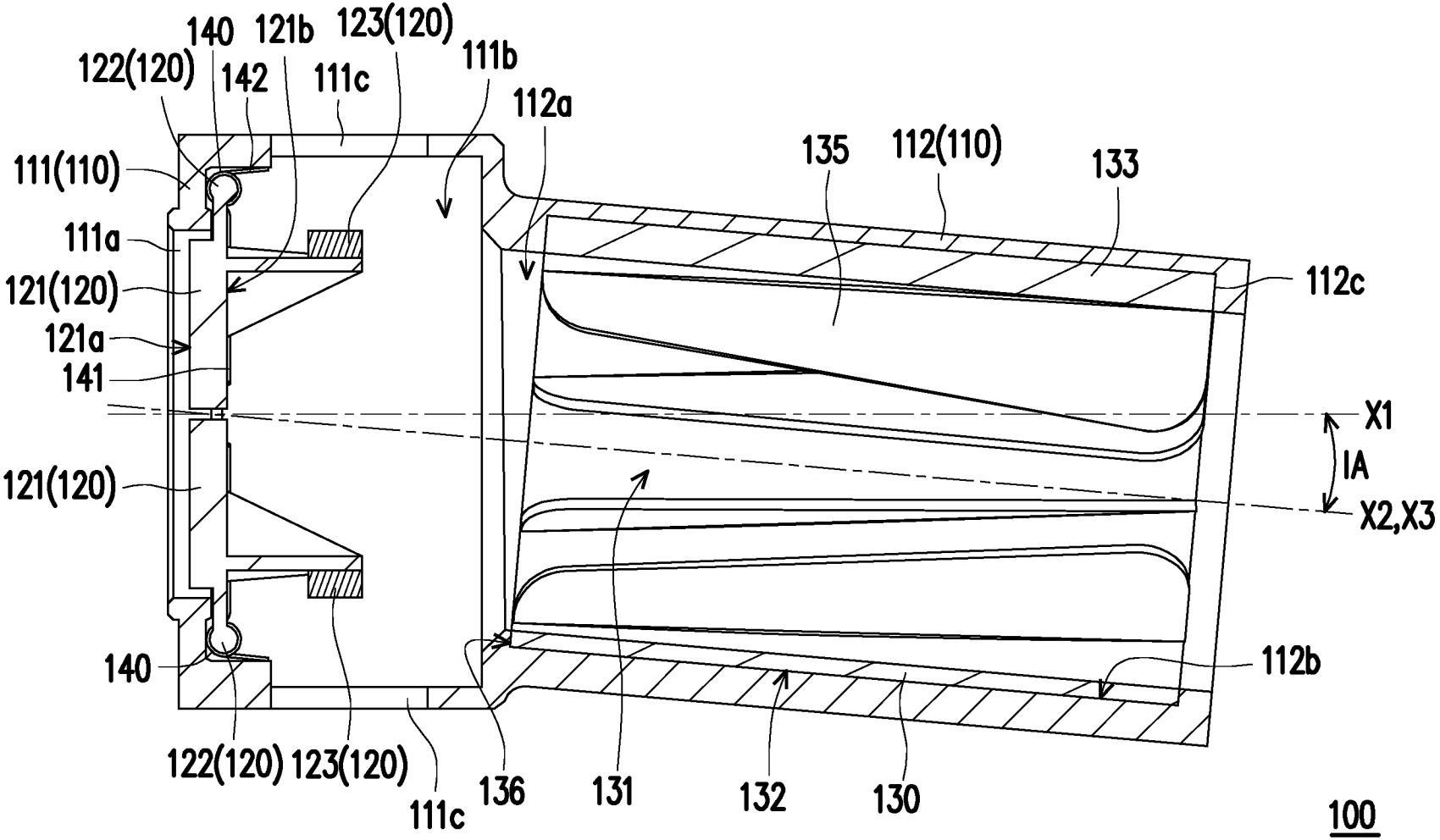
FIG. 2A and FIG. 2B are schematic sectional views of the wine bottle positioning device in a closed state and an open state according to the first embodiment of the present disclosure.
Figure 2B:
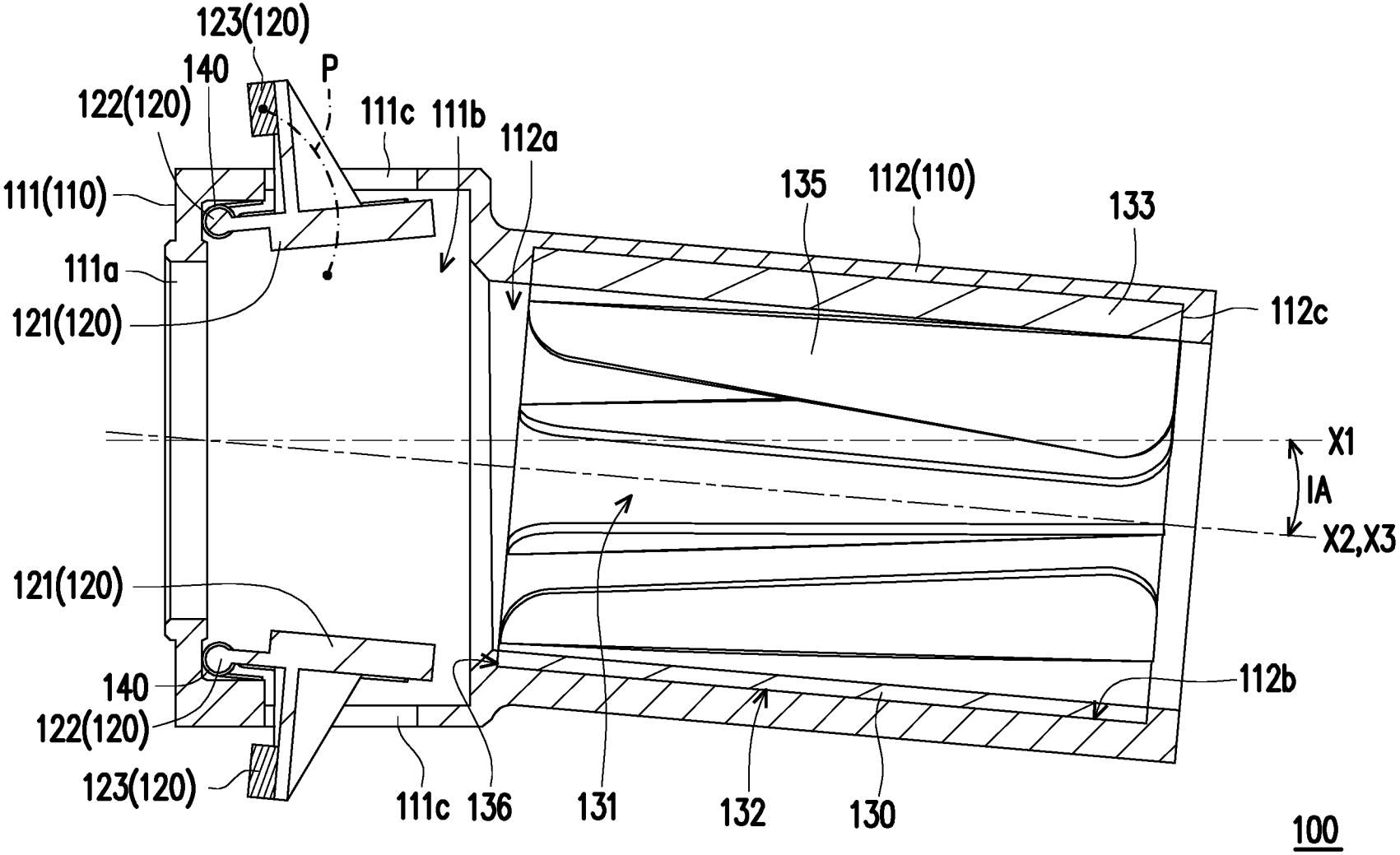
Figure 3A:
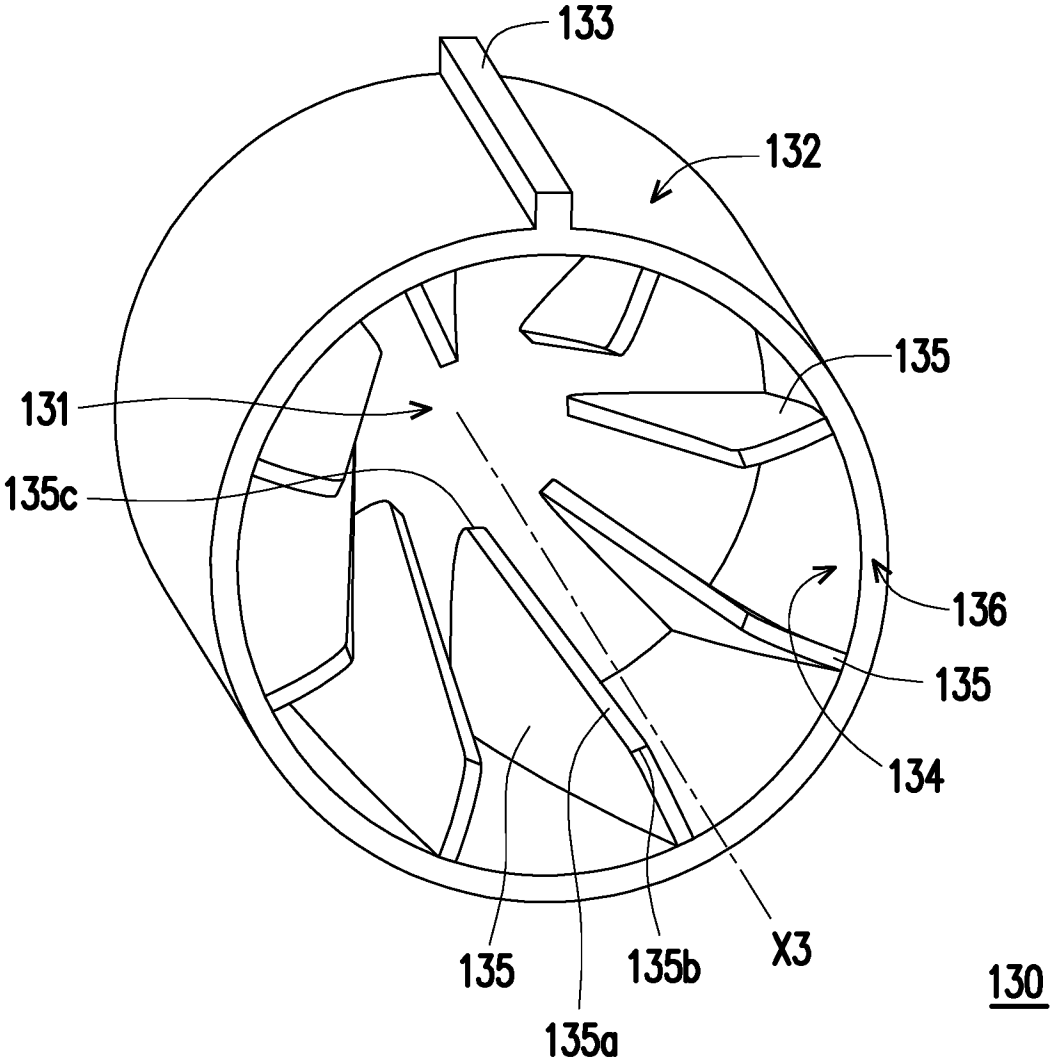
FIG. 3A and FIG. 3B are schematic diagrams of an auxiliary positioning sleeve from two different angles according to the first embodiment of the present disclosure.
Figure 3B:
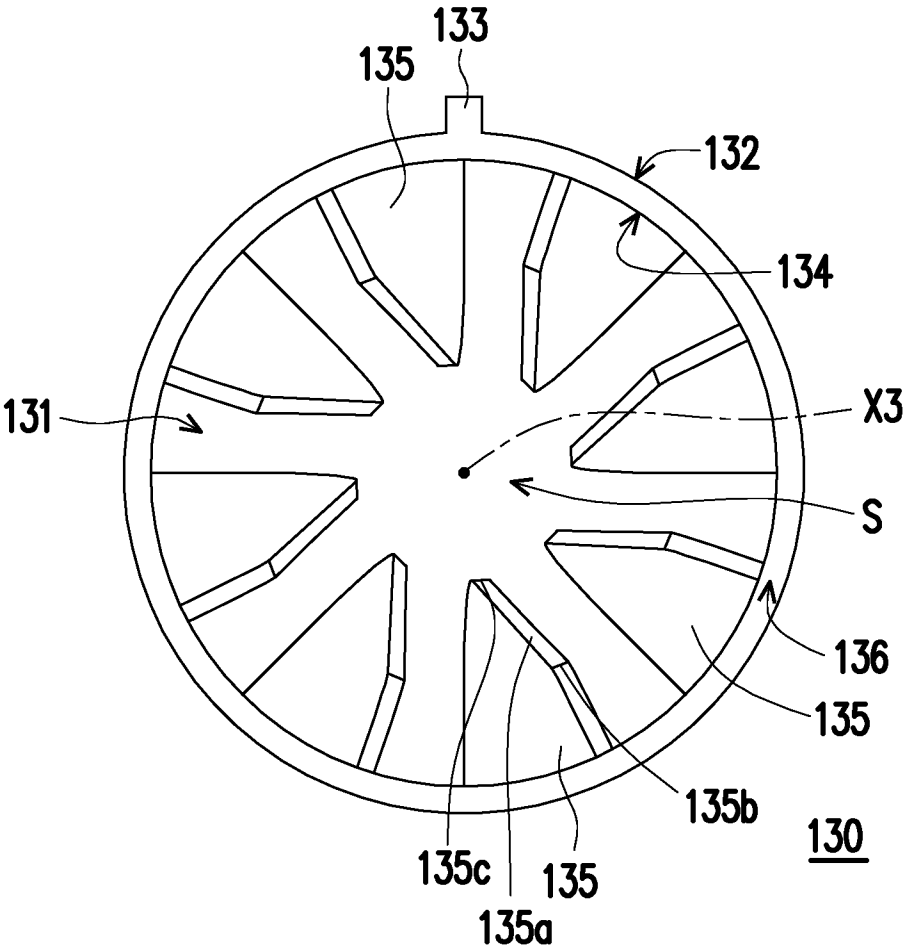
Figure 4:
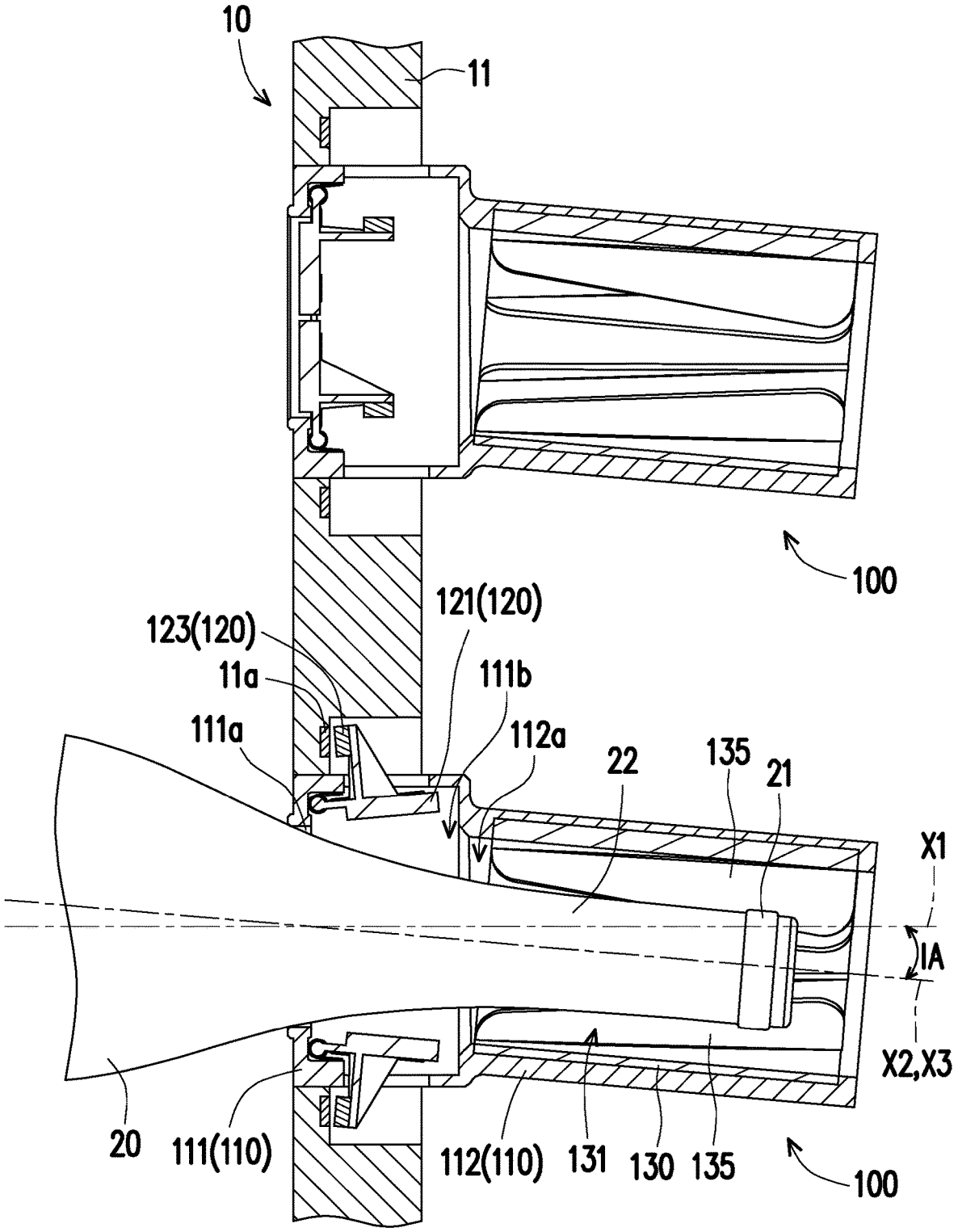
FIG. 4 is a schematic partial sectional view of a wine storage apparatus using the wine bottle positioning device according to the first embodiment of the present disclosure.

FIG. 1A and FIG. 1B are schematic diagrams of a wine bottle positioning device in a closed state and an open state according to a first embodiment of the present disclosure. FIG. 2A and FIG. 2B are schematic sectional views of the wine bottle positioning device in a closed state and an open state according to the first embodiment of the present disclosure. FIG. 3A and FIG. 3B are schematic diagrams of an auxiliary positioning sleeve from two different angles according to the first embodiment of the present disclosure. FIG. 4 is a schematic partial sectional view of a wine storage apparatus using the wine bottle positioning device according to the first embodiment of the present disclosure. Referring to FIG. 1A to FIG. 2B, and FIG. 4, in this embodiment, the wine bottle positioning device 100 may be applied to a wine storage apparatus 10, and the wine storage apparatus 10 may be used for a wine cabinet, a wine cellar or a wine storage warehouse. Specifically, a plurality of wine bottle positioning device 100 may be integrated on a shelf 11 to increase a storage amount of wine. On the other hand, by inserting and positioning an external wine bottle 20 in any one wine bottle positioning device 100, the external wine bottle 20 can be ensured to lie flat, and further be prevented from displacement or damage caused by vibration, shake or impact, thereby improving safety and reliability of wine storage. That is to say, the external wine bottle 20 may be a workpiece, and the wine bottle positioning device 10 is configured to position the workpiece. In general, the external wine bottle 20 is not an element or a component of the positioning device 10.

Specifically, the wine bottle positioning device 100 includes a sleeving component 110, a door cover 120 and an auxiliary positioning sleeve 130. The sleeving component 110 includes a positioning base 111 and a positioning sleeve 112 connected to the positioning base 111. The positioning base 111 includes an opening 111*a* and a first internal space 111*b* communicated with the opening 111*a*. The positioning sleeve 112 includes a second internal space 112*a* communicated with the first internal space 111*b*. For example, a bottle mouth 21 and a bottleneck 22 of the external wine bottle 20 may be inserted in the first internal space 111*b* of the positioning base 111 and the second internal space 112*a* of the positioning sleeve 112 through the opening 111*a* of the positioning base 111. After the external wine bottle 20 is inserted to a right position and thus being fixed, the bottle mouth 21 and a part of the bottleneck 22 of the external wine bottle 20 are located in the second internal space 112*a* of the positioning sleeve 112, and another part of the bottleneck 22 of the external wine bottle 20 is located in the first internal space 111*b* of the positioning base 111. In other words, the bottleneck 22 of the external wine bottle 20 is sheathed by the sleeving component 110. Being pulled by a gravity of the external wine bottle 20, the bottleneck 22 of the external wine bottle 20 leans against the positioning base 111, and the bottle mouth 21 of the external wine bottle 20 is blocked by the positioning sleeve 112, so that the external wine bottle 20 is in a static equilibrium state.

On the other hand, the door cover 120 is movably disposed at the positioning base 111, and configured to open the opening 111*a* (illustrated in FIG. 1B and FIG. 2B) or close the opening 111*a* (illustrated in FIG. 1A and FIG. 2A). For example, a moving mechanism of the door cover 120 may be a sliding mechanism, a rotation mechanism, or a combination of both. The door cover 120 may be located outside or inside the first internal space 111*b* of the positioning base 111. In this embodiment, the moving mechanism of the door cover 120 uses the sliding mechanism, and the door cover 120 is located inside the first internal space 111*b* of the positioning base 111. It should be specifically noted that when the door cover 120 closes the opening 111*a*, at least part of the door cover 120 is located inside the opening 111*a*.

Further, the door cover 120 includes a cover portion 121 and a pivot portion connected to the cover portion 121. The cover portion 121 opens the opening 111*a* (illustrated in FIG. 1B and FIG. 2B) and closes the opening 111*a* (illustrated in FIG. 1A and FIG. 2A), and the pivot portion 122 is pivoted to the positioning base 111. The cover portion 121 includes an outer surface 121*a* and an inner surface 121*b* facing away from the outer surface 121*a*. When the door cover 120 closes the opening 111*a*, the outer surface 121*a* of the cover portion 121 is exposed from the opening 111*a*. On the other hand, the wine bottle positioning device 100 further includes a torsion spring 140 of the pivot portion 122 sleeved on the door cover 120. The torsion spring 140 includes a first end 141 and a second 142 opposite to the first end 141, the first end 141 abuts against the inner surface 121*b* of the cover portion 121, and the second end 142 abuts against the positioning base 111.

As shown in FIG. 1A and FIG. 2A, when the door cover 120 closes the opening 111*a*, the first end 141 of the torsion spring 140 may press against the cover portion 121 to prevent the door cover 120 from freely rotating relative to the positioning base 111 and further making the cover portion 121 move away from the opening 111*a*. When the external wine bottle 20 is not inserted into the wine bottle positioning device 100, the door cover 120 remains in the closed state. As shown in FIG. 1B and FIG. 2B, if the external wine bottle 20 is inserted into the wine bottle positioning device 100, the cover portion 121 is moved away from the opening 111*a* by being pushed by the external wine bottle 20, so as to open the opening 111*a*. After the door cover 120 is rotated relative to the positioning base 111 through the pivot portion 122, the torsion spring 140 is deformed elastically by being pressed by the cover portion 121. As shown in FIG. 1A and FIG. 2A, once the external wine bottle 20 is moved out of the wine bottle positioning device 100, an elastic force of the torsion spring 140 may drive the door cover 120 to rotate relative to the positioning base 111, so that the cover portion 121 is moved back to the opening 111*a* to close the opening 111*a* again. In other words, an operating mode of the door cover 120 or an open and closed mode of the opening 111*a* may use a semi-automatic mode. In another embodiment, an operating mode of the door cover or an open and closed mode of the opening may use a manual mode or an automatic mode, and the present disclosure is not limited thereto.

Referring to FIG. 1A to FIG. 2B, and FIG. 4, in this embodiment, the door cover 120 further includes a sensing portion 123 of the inner surface 121*b* connected to the cover portion 121, and the positioning base 111 further includes an open groove 111*c* communicated with the first internal space 111*b*. Based on rotation of the door cover 120 relative to the positioning base 111, the sensing portion 123 may define a moving path P, and the open groove 111*c* is located on the moving path P of the sensing portion 123. After the door cover 120 is rotated relative to the positioning base 111 and opens the opening 111*a*, the sensing portion 123 is moved out of the first internal space 111*b* through the open groove 111*c*.

On the other hand, the positioning base 111 further includes a first surface 111*d* and a second surface 111*e* intersecting the first surface 111*d*. The opening 111*a* is located at the first surface 111*d*, and the open groove 111*c* is located at the second surface 111*e*. It should be specifically noted that a quantity of the door cover 120 in this embodiment may be two, and is set by group. Each door cover 120 matches with at least one torsion spring 140. The sensing portion 123 of the door cover 120 is configured in one-to-one correspondence with the open groove 111*c*, therefore, a quantity of the open grooves is two. In another embodiment, the quantity of the door covers and the quantity of the open grooves may be increased and decreased according to design requirement.

As shown in FIG. 2B and FIG. 4, the positioning base 111 of the wine bottle positioning device 100 is installed and positioned on the shelf 11. The shelf 11 is provided with a plurality of sensors 11*a*, and each wine bottle positioning device 100 corresponds to at least one sensor 11*a*. After inserting the external wine bottle 20 into the wine bottle positioning device 100, the sensing portion 123 is moved out of the first internal space 111*b* through the open groove 111*c* and aligned to the sensor 11*a*, and the sensor 11*a* that senses the sensing portion 123 may transmit a signal to a processor. Then, the processor may read a location of the external wine bottle 20 in the wine storage apparatus 10, and further store the location in a storage device. Subsequently, a user may write information, such as a category, vintage, brand (or winery), price, country, region, level of the external wine bottle 20, in the storage device to facilitate management. For example, the sensor 11*a* and the sensing portion 123 may be a combination of a magnetic sensor and a magnetic element, or a combination of a light sensor and a light reflection pattern, or a combination of an image sensor and a bar code. It should be specifically noted that the sensor 11*a* may also use another non-contact type sensor, or a contact type sensor.

Referring to FIG. 2A to FIG. 4, the auxiliary positioning sleeve 130 is disposed in the second internal space 112*a* of the positioning sleeve 112. The auxiliary positioning sleeve 130 includes a third internal space 131, and the third internal pace 131 is communicated with the first internal space 111*b*. Therefore, the bottle mouth 21 and the bottleneck 22 of the external wine bottle 20 may be inserted in the first internal space 111*b* of the positioning base 111 and the third internal space 131 of the auxiliary positioning sleeve 130 through the opening 111*a* of the positioning base 111. After the external wine bottle 20 is inserted to a right position and thus being fixed, the bottle mouth 21 and a part of the bottleneck 22 of the external wine bottle 20 are located in the third internal space 131 of the auxiliary positioning sleeve 130, and another part of the bottleneck 22 of the external wine bottle 20 is located in the first internal space 111*b* of the positioning base 111. Being pulled by a gravity of the external wine bottle 20, the bottleneck 22 of the external wine bottle 20 leans against the positioning base 111, and the bottle mouth 21 of the external wine bottle 20 is blocked by the auxiliary positioning sleeve 130, so that the external wine bottle 20 is in a static equilibrium state.

For example, a material of the auxiliary positioning sleeve 130 may use rubber or silicone to increase friction between the external wine bottle 20 and the auxiliary positioning sleeve 130, so as to prevent the external wine bottle 20 from easily sliding out of the wine bottle positioning device 100. On the other hand, the positioning sleeve 112 further includes an inner wall surface 112*b* surrounding the second internal space 112*a* and a first positioning portion 112*c* located on the inner wall surface 112*b*, and the auxiliary positioning sleeve 130 further includes an outer wall surface 132 facing away from the third internal space 131 and a second positioning portion 133 located on the outer wall surface 132. Specifically, the outer wall surface 132 of the auxiliary positioning sleeve 130 faces the inner wall surface 112*b* of the positioning sleeve 112, and the second positioning portion 133 is engaged with the first positioning portion 112*c*. The second positioning portion 133 and the first positioning portion 112*c* may be a combination of a protrusion and a slot, to prevent the auxiliary positioning sleeve 130 from sliding or rotating relative to the positioning sleeve 112. In another embodiment, the auxiliary positioning sleeve may be integrally formed on the inner wall surface of the positioning sleeve, and may be manufactured by double injection molding.

In this embodiment, the first internal space 111*b* of the positioning base 111 has a first depth axis X1, the second internal space 111*a* of the positioning sleeve 112 has a second depth axis X2, and the third internal space 131 of the auxiliary positioning sleeve 130 has a third depth axis X3. Specifically, the first depth axis X1 and the second depth axis X2 are not parallel to each other, and an angle IA between the first depth axis X1 and the second depth axis X2 is ranged from 3 to 7 degrees. On the other hand, the second depth axis X2 and the third depth axis X3 are coaxial. Therefore, the angle IA between the first depth axis X1 and the third depth axis X3 is also ranged from 3 to 7 degrees.

Specifically, the second depth axis X2 and the third depth axis X3 incline downward with respect to the first depth axis X1. After placing the external wine bottle 20 to a right position and thus being fixed, the obliquely configured auxiliary positioning sleeve 130 blocks the bottle mouth 21 of the external wine bottle 20 to lift up the entire body of the external wine bottle 20 with respect to the first depth axis X1 of the first internal space 110*b* of the positioning base 111, thereby preventing the external wine bottle 20 from easily sliding out of the wine bottle positioning device 100 due to the force of gravity.

In this embodiment, the auxiliary positioning sleeve 130 further includes an inner wall surface 134 surrounding the third internal space 131 and a plurality of positioning fins 135 connected to the inner wall surface 134, and the positioning fins 135 are arranged alternately around the third depth axis X3 of the third internal space 131. Specifically, each positioning fin 135 extends along the third depth axis X3, and includes a positioning surface 135*a* facing away from the inner wall surface 134. The positioning surfaces 135*a* of the positioning fins 135 define a positioning channel S. The external wine bottle 20 is inserted in the positioning channel S, and each positioning fin 135 may be in contact with the external wine bottle 20 through the positioning surface 135*a*. On the other hand, the positioning fins 135 can be compressed by the bottle mouth 21 and the bottleneck 22 of the external wine bottle 20 and thus elastically deforming, and the positioning fins 135 generate clamping force and supporting force to the bottle mouth 21 and the bottleneck 22 of the external wine bottle 20, so that the external wine bottle 20 can be inserted and positioned in the wine bottle positioning device 100 firmly.

Each positioning fin 135 extends along the third depth axis X3, and is in a spiral shape. A height of the positioning surface 135*a* of each positioning fin 135 increases along the third depth axis X3. Specifically, the auxiliary positioning sleeve 130 further includes an outer wall surface 136 connected to the inner wall surface 134, and the outer wall surface 136 is close to the first internal space 111*b*. Each positioning fin 135 further includes a first positioning end 135*b* close to the outer wall surface 136 (or close to the opening 111*a*) and a second positioning end 135*c* away from the outer wall surface 136 (or away from the opening 111*a*), and a height of the positioning surface 135*a* of each positioning fin 135 gradually increases along the third depth axis X3 from the first positioning end 135*b* to the second positioning end 135*c*.

Based on the geometric design of the positioning fins 135, the effect of clamping and supporting the bottle mouth 21 and the bottleneck 22 of the external wine bottle 20 by the positioning fins 135 can be improved, and the bottle mouth 21 and the bottleneck 22 of the external wine bottle 20 can be successfully inserted into the positioning channel S defined by the positioning surfaces 135*a* of the positioning fins 135. In addition, when the bottle mouth 21 and the bottleneck 22 of the external wine bottle 20 are inserted into the wine bottle positioning device 100, as an insertion depth of the bottle mouth 21 and the bottleneck 22 increases, resistance generated by the positioning fins 135 to the bottle mouth 21 and the bottleneck 22 increases as well. Therefore, the user needs to impose more strength on the external wine bottle 20 to obtain an incremental operation feeling.

The auxiliary positioning sleeve 130 of the wine bottle positioning device 100 may be replaced with auxiliary positioning sleeves 130A to 130C in the following embodiments. Design differences between the auxiliary positioning sleeves are described below.

Figure 5A:
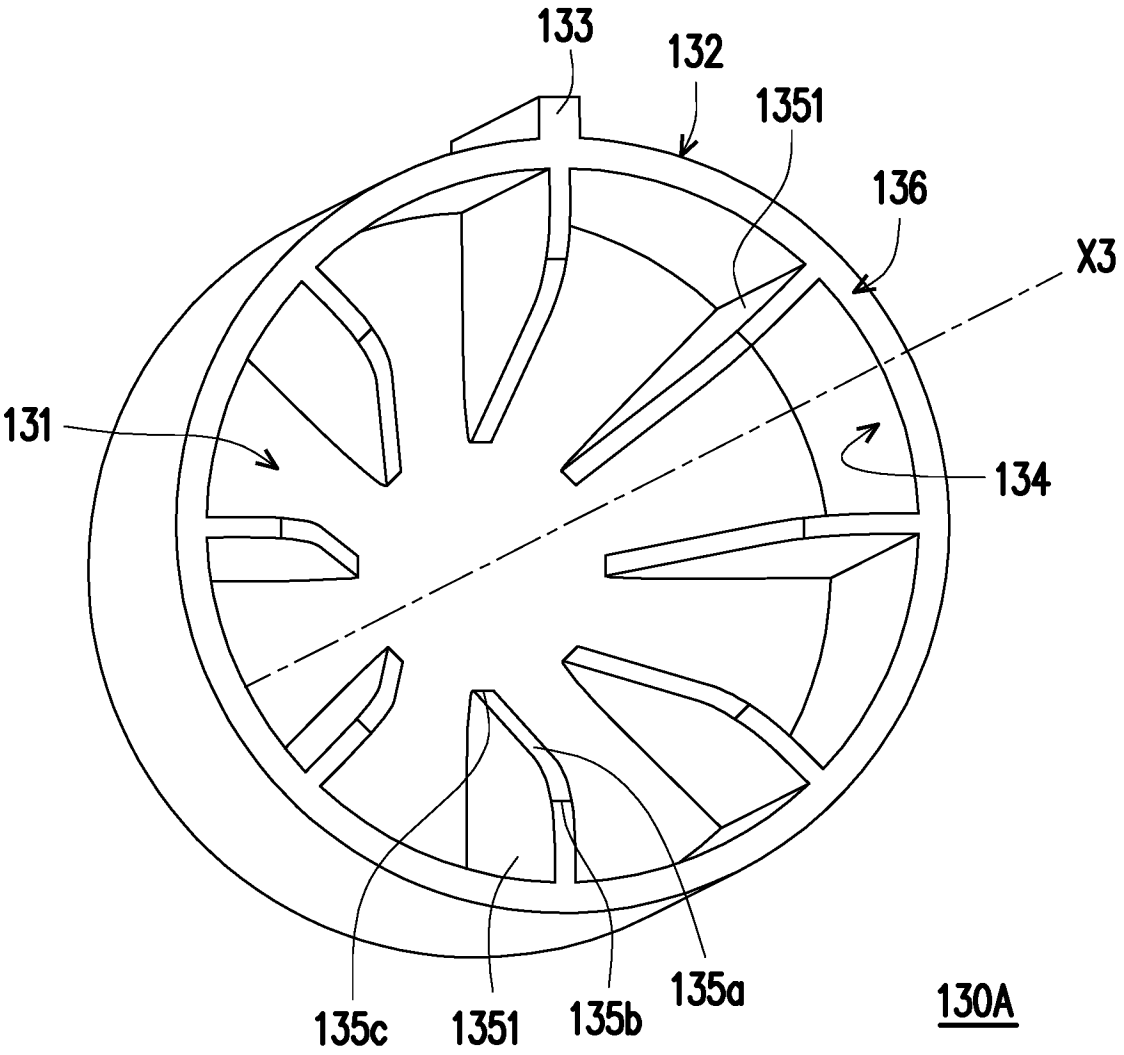
FIG. 5A and FIG. 5B are schematic diagrams of an auxiliary positioning sleeve from two different angles according to a second embodiment of the present disclosure.
Figure 5B:
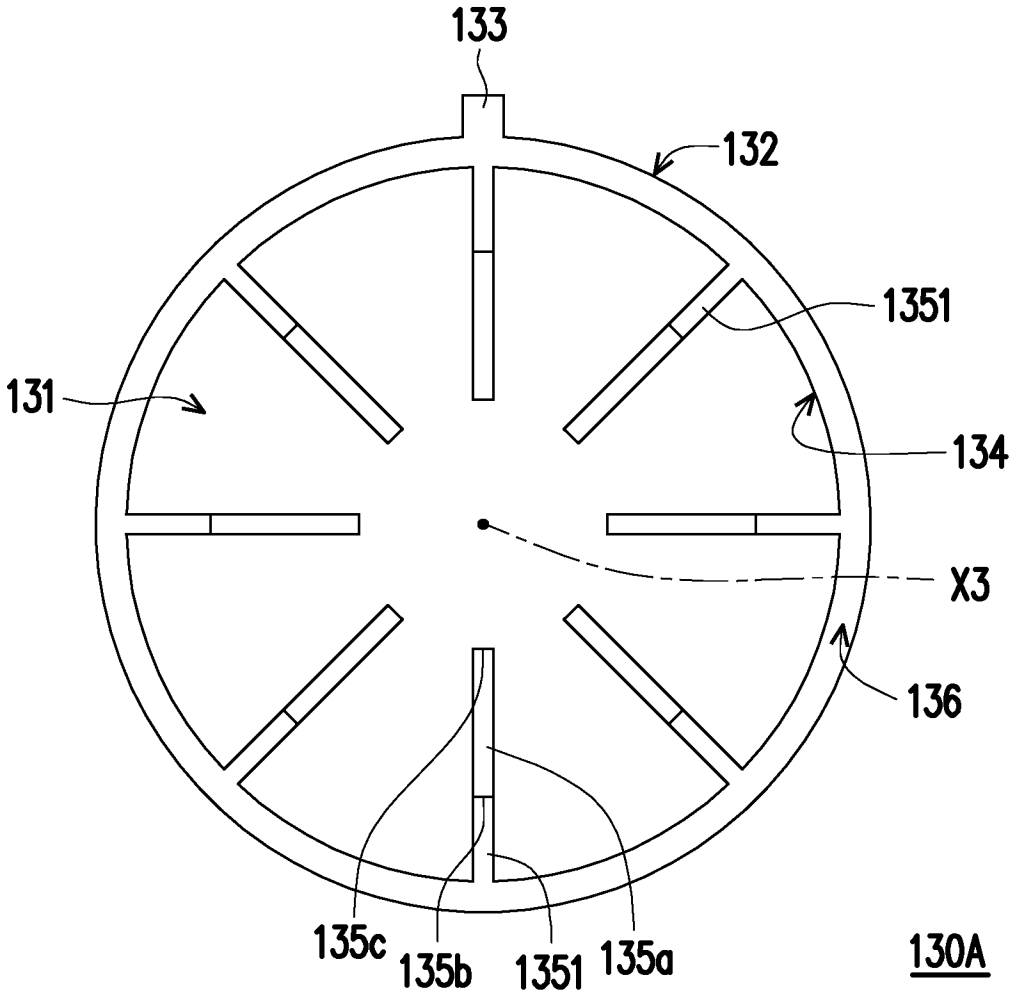

FIG. 5A and FIG. 5B are schematic diagrams of an auxiliary positioning sleeve from two different angles according to a second embodiment of the present disclosure. Referring to FIG. 5A and FIG. 5B, a design principle of the auxiliary positioning sleeve 130A of this embodiment is similar to that of the auxiliary positioning sleeve 130 of the first embodiment, the difference is that the positioning fin 1351 of the auxiliary positioning sleeve 130A is in the shape of a flat plate.

Figure 6A:
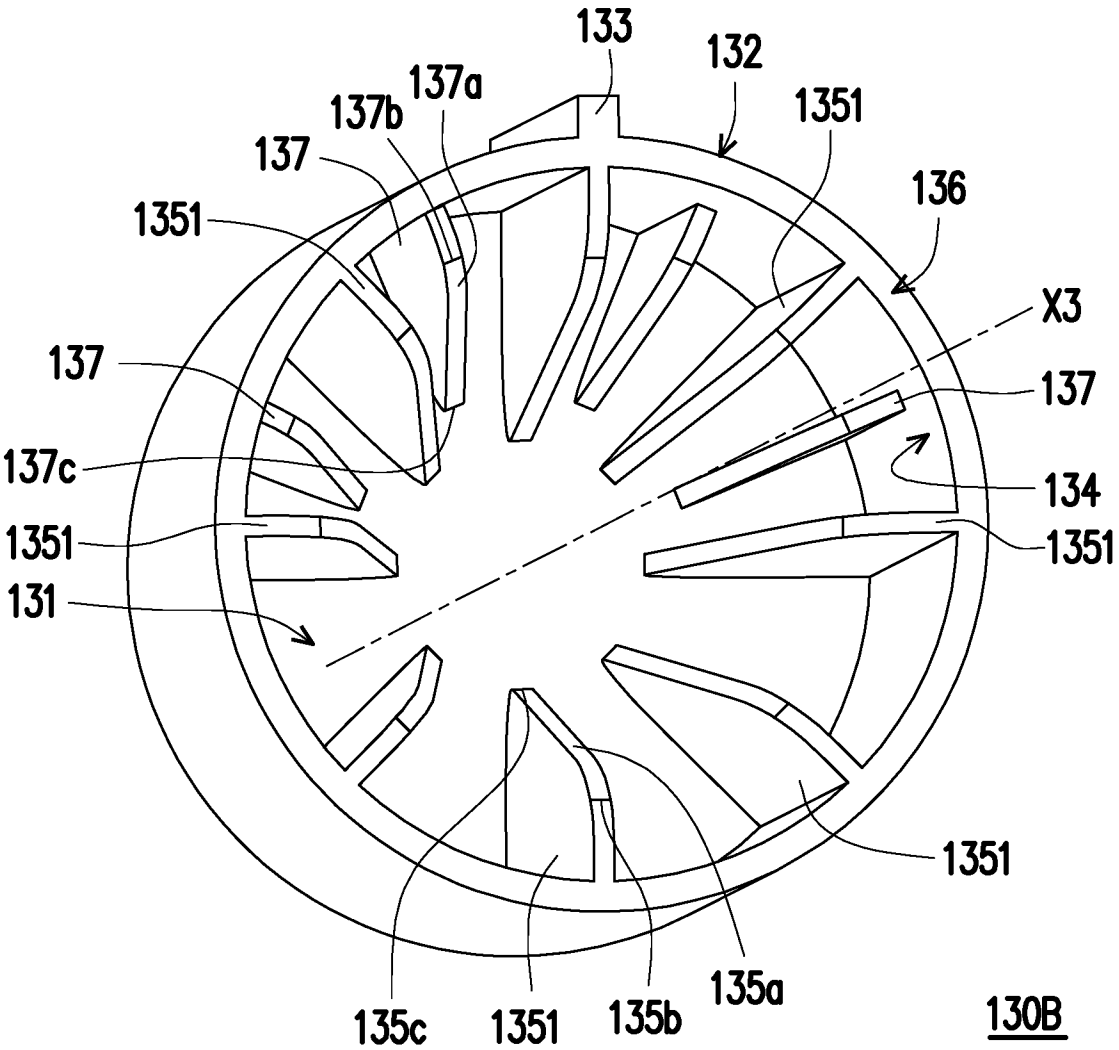
FIG. 6A and FIG. 6B are schematic diagrams of an auxiliary positioning sleeve from two different angles according to a third embodiment of the present disclosure.
Figure 6B:
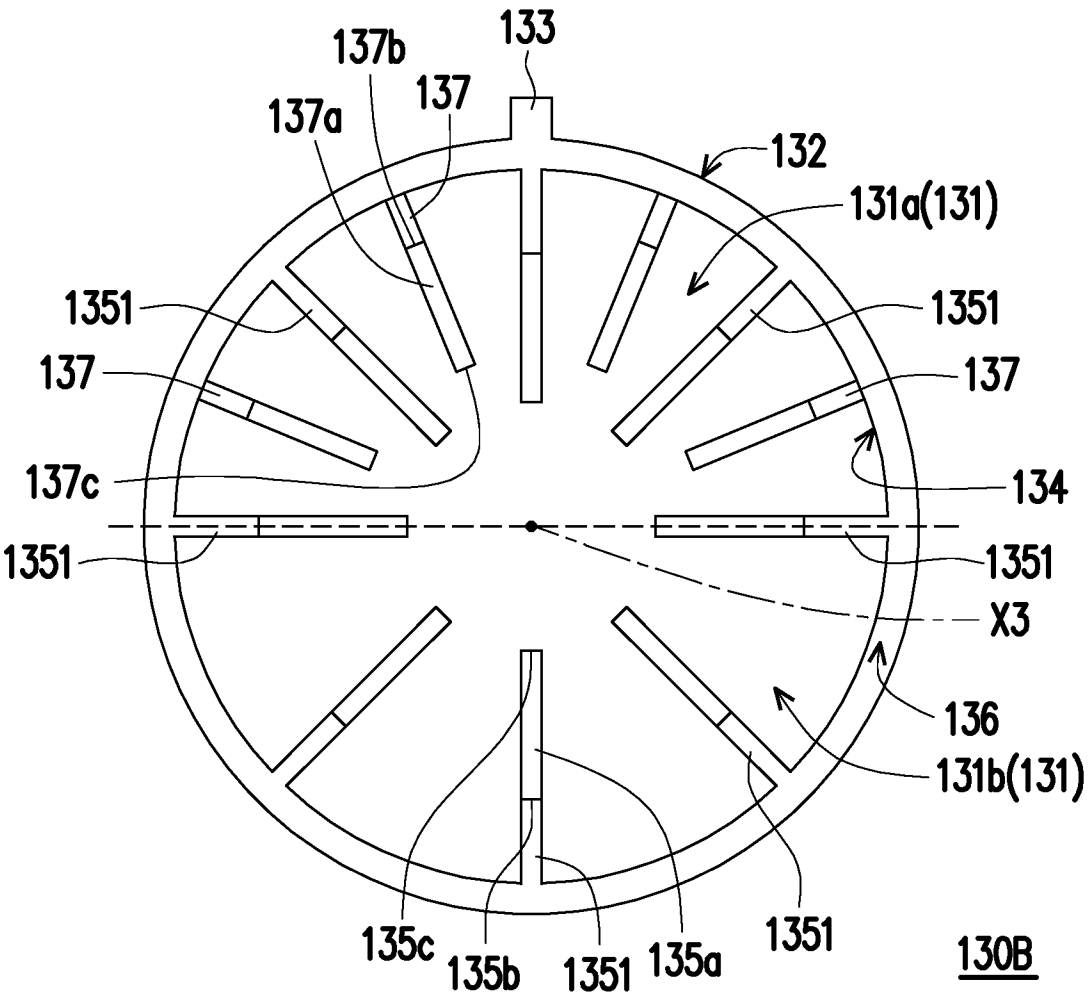

FIG. 6A and FIG. 6B are schematic diagrams of an auxiliary positioning sleeve from two different angles according to a third embodiment of the present disclosure. Referring to FIG. 6A and FIG. 6B, a design principle of the auxiliary positioning sleeve 130B of this embodiment is similar to that of the auxiliary positioning sleeve 130A of the second embodiment, and the difference is that the auxiliary positioning sleeve 130B further includes a plurality of auxiliary fins 137 connected to the inner wall surface 134. These auxiliary fins 137 are arranged alternately around the third depth axis X3, and any two adjacent auxiliary fins 137 are separated by one positioning fin 1351. Further, each auxiliary fin 137 extends along the third depth axis X3, wherein each auxiliary fin 137 is in the shape of a flat plate and includes an auxiliary surface 137*a* facing away from the inner wall surface 134. A height of the auxiliary surface 137*a* of each auxiliary fin 137 increases along the third depth axis X3, and on a same cross section perpendicular to the third depth axis X3, is lower than a height of the positioning surface 135*a* of each positioning fin 1351.

Each auxiliary fin 137 further includes a first auxiliary end 137*b* close to the outer wall surface 136 (or close to the opening 111*a*) and a second auxiliary end 137*c* away from the outer wall surface 136 (or away from the opening 111*a*), and a height of the auxiliary surface 137*a* of each auxiliary fin 137 increases along the third depth axis X3 from the first auxiliary end 137*b* to the second auxiliary end 137*c*. On the other hand, a height of the positioning surface 135*a*, of each positioning fin 1351, on the first positioning end 135*b* is greater than a height of the auxiliary surface 137*a*, of each auxiliary fin 137, on the first auxiliary end 137*b*. A height of the positioning surface 135*a*, of each positioning fin 1351, on the second positioning end 135*c* is greater than a height of the auxiliary surface 137*a*, of each auxiliary fin 137, on the second auxiliary end 137*c*.

In this embodiment, compared with the first positioning end 135*b* of each positioning fin 1351, the first auxiliary end 137*b* of each auxiliary fin 137 is farther away from the outer wall surface 136 (or farther away from the opening 111*a*). On the other hand, the third internal space 131 of the auxiliary positioning sleeve 130 can be divided into an upper half space 131*a* and a lower half space 131*b*. The auxiliary fins 137 are distributed in the upper half space 131*a*, and the positioning fins 1351 are distributed in the upper half space 131*a* and the lower half space 131*b*. Specifically, the auxiliary fins 137 may be used to improve the effect of clamping and supporting the external wine bottles 20 having different bottle mouths and bottlenecks in small size.

Figure 7A:
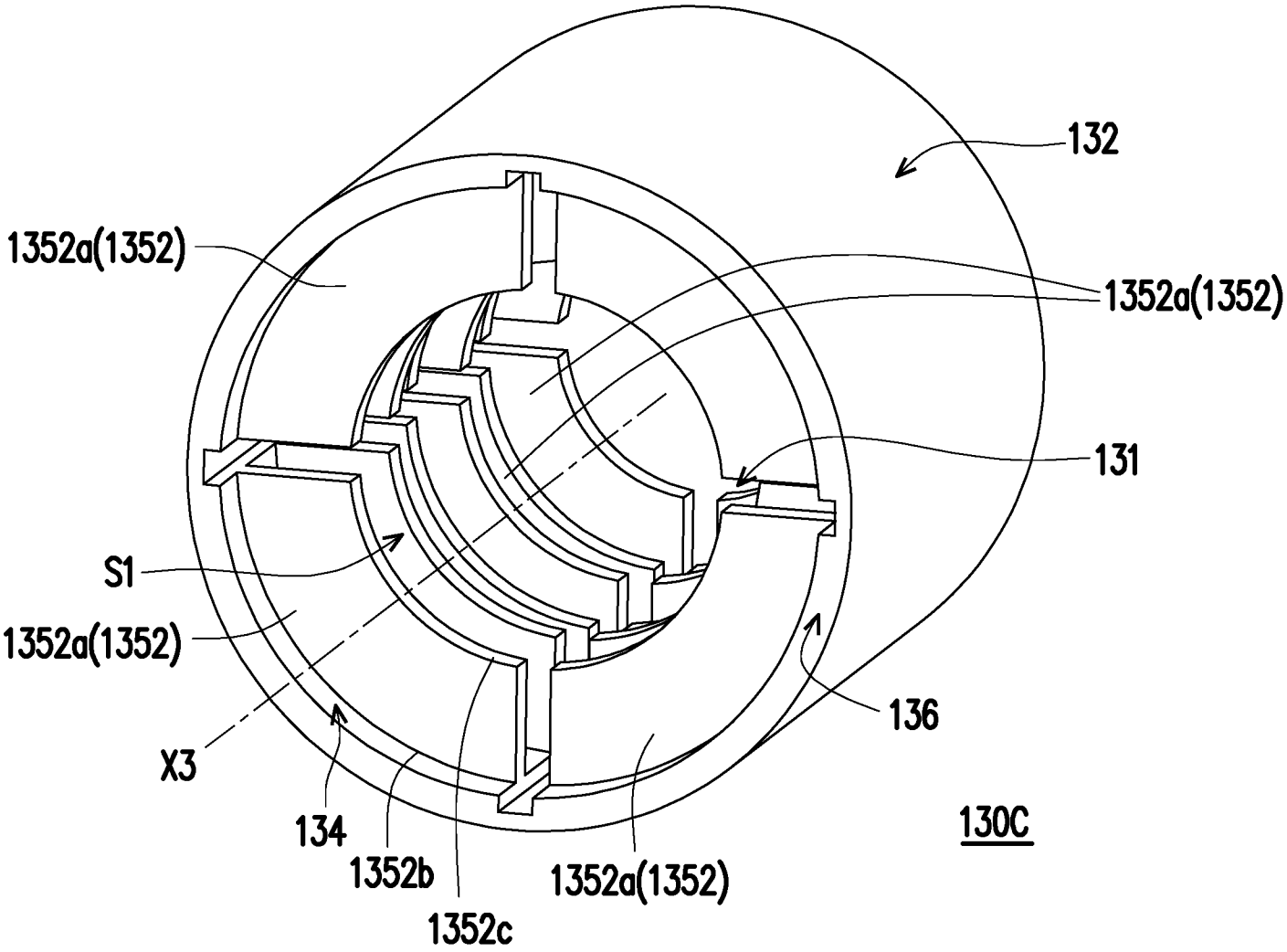
FIG. 7A and FIG. 7B are schematic diagrams of an auxiliary positioning sleeve from two different angles according to a fourth embodiment of the present disclosure.
Figure 7B:
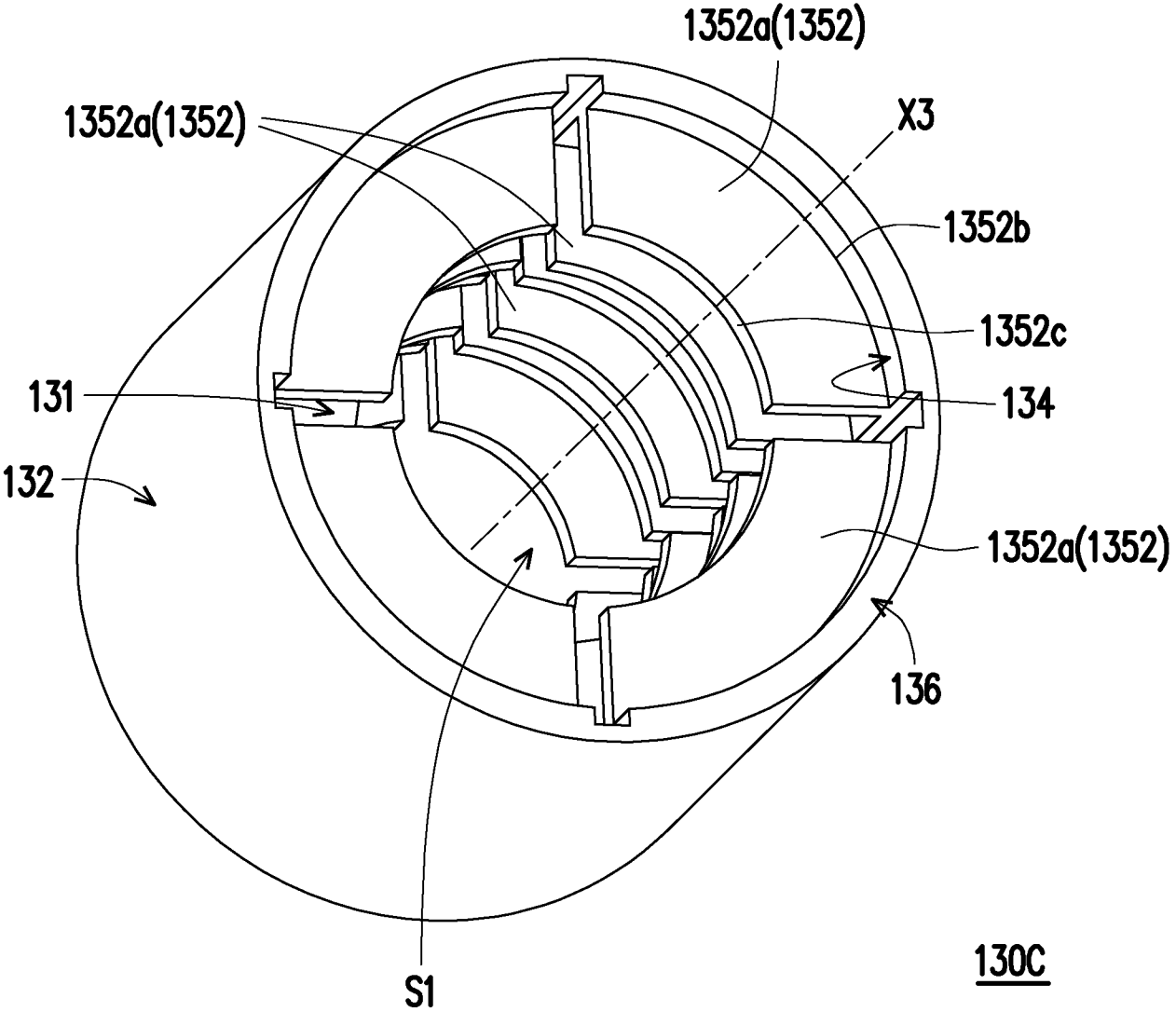

FIG. 7A and FIG. 7B are schematic diagrams of an auxiliary positioning sleeve from two different angles according to a fourth embodiment of the present disclosure. Referring to FIG. 7A and FIG. 7B, the auxiliary positioning sleeve 130C of this embodiment is different from the auxiliary positioning sleeve 130 of the first embodiment. Specifically, the auxiliary positioning sleeve 130C of this embodiment includes a plurality of positioning fin sets 1352 connected to the inner wall surface 134 and arranged alternately along the third depth axis X3. On the other hand, each positioning fin set 1352 includes at least two (four schematically illustrated) positioning fins 1352*a* arranged alternately around the third depth axis X3. Each positioning fin 1352*a* is in a sector shape on a cross section perpendicular to the third depth axis X3, and includes a convex curved surface 1352*b* connected to the inner wall surface 134 and a concave curved surface 1352*c* facing away from the convex curved surface 1352*b*. The concave curved surfaces 1352*c* of the positioning fins 1352*a* define a positioning channel S1 for inserting the external wine bottles.

It should be noted that, in another embodiment, the inner wall surface of the auxiliary positioning sleeve may be a smooth surface, and may not be provided with positioning fins and auxiliary fins. Alternatively, no auxiliary positioning sleeve is disposed in the second internal space of the positioning sleeve.

Different types of wine bottles are listed below for description. Refer to Table 1.

TABLE 1

| Wine bottle type | Wine bottle 1 | Wine bottle 2 | Wine bottle 3 | Wine bottle 4 | Wine bottle 5 |
|---|---|---|---|---|---|
| Inclined angle of wine bottle | 4 degrees | 4 degrees | 4 degrees | 4 degrees | 4 degrees |
| Inclined angle of positioning sleeve | 5 degrees | 5 degrees | 5 degrees | 5 degrees | 5 degrees |
| Drop angle | 1 degree | 1 degree | 1 degree | 1 degree | 1 degree |
| Wine bottle weight/Volume | 1020 g/500 mL | 1350 g/750 mL | 1285 g/750 mL | 1245 g/750 mL | 1620 g/750 mL |
| Bottle mouth size (diameter) | 27 mm | 27 mm | 27 mm | 30 mm | 30 mm |
| Bottle mouth ring size (diameter) | 29.7 mm | 29.5 mm | 29.5 mm | 31.7 mm | 33 mm |
| Wine bottle length | 279 ± 1.8 mm | 312 ± 1.8 mm | 279 ± 1.8 mm | 279 ± 1.8 mm | 305 ± 1.8 mm |
| Wine bottle diameter | 64 mm | 74 mm | 82.5 mm | 81.5 mm | 86.5 mm |

In Table 1, for example, the Wine bottle 1 may be a wine bottle used for sweet white wine, the Wine bottle 2 may be a wine bottle used for the Bordeaux region, and the Wine bottle 3 to the Wine bottle 5 may be wine bottles used for the Burgundy region. The wine bottle positioning device 100 in the first embodiment or other wine bottle positioning devices which cooperated with the auxiliary positioning sleeves 130A to 130C can be used for inserting and fixing the Wine bottle 1 to the Wine bottle 5 inside. That is, for size designs of the wine bottle positioning device 100 of the first embodiment or other wine bottle positioning devices attached with the auxiliary positioning sleeves 130A to 130C, it is needed to consider sizes of all wine bottles to improve universality and position all types of wine bottles firmly.

On the other hand, as shown in FIG. 2A and FIG. 2B, the first depth axis X1 of the first internal space 111*b* of the positioning base 111 are the second depth axis of the second internal space 112*a* of the positioning sleeve 112 are not parallel to each other, and the angle IA between the first depth axis X1 and the second depth axis X2 is ranged from 3 to 7 degrees. The angle IA is the inclined angle of the positioning sleeve 112, and a preferable inclined angle is 5 degrees. After inserting and fixing the Wine bottle 1 to the Wine bottle 5 into the wine bottle positioning device 100 disclosed in the first embodiment or other wine bottle positioning devices which cooperated with the auxiliary positioning sleeves 130A to 130C, driven by the gravity, the Wine bottle 1 to the Wine bottle 5 slightly drop, the drop angle is 1 degree. The entire bodies of the Wine bottle 1 to the Wine bottle 5 are slightly lifted up with respect to the first depth axis X1 of the first internal space 111*b* of the positioning base 111 to maintain the inclined angle of the wine bottles at 4 degrees.

Based on the above, by inserting and positioning an external wine bottle in the wine bottle positioning device of the present disclosure, the external wine bottle can be ensured to lie flat, and further be prevented from displacement or damage caused by vibration, shake or impact, thereby improving safety and reliability of wine storage. For example, an auxiliary positioning sleeve is disposed in a positioning sleeve of the wine bottle positioning device, and a plurality of positioning fins arranged alternately are formed on an inner wall surface of the auxiliary positioning sleeve. The positioning fins can be compressed by the bottle mouth and the bottleneck of the external wine bottle and thus elastically deforming, and the positioning fins generate clamping force and supporting force to the bottle mouth and the bottleneck of the external wine bottle, so that the external wine bottle can be inserted and positioned in the wine bottle positioning device firmly. On the other hand, the wine storage apparatus of the present disclosure using the wine bottle positioning device also improves the safety and reliability of wine storage.

Although the disclosure is described with reference to the above embodiments, the embodiments are not intended to limit the disclosure. Any person of ordinary skill in the art may make variations and modifications without departing from the spirit and scope of the disclosure. Therefore, the protection scope of the disclosure should be subject to the appended claims.

What is claimed is:

1. A wine bottle positioning device, comprising:

a sleeving component, comprising a positioning base and a positioning sleeve connected to the positioning base, wherein the positioning base comprises an opening and a first internal space communicated with the opening, the positioning sleeve comprises a second internal space communicated with the first internal space, the first internal space of the positioning base comprises a first depth axis, the second internal space of the positioning sleeve comprises a second depth axis, and an angle between the first depth axis and the second depth axis is ranged from 3 to 7 degrees; and a door cover, movably disposed at the positioning base.

2. The wine bottle positioning device according to claim 1, wherein the door cover is located in the first internal space, the door cover comprises a cover portion and a pivot portion connected to the cover portion, the cover portion is configured to open or close the opening, and the pivot portion is pivoted to the positioning base.

3. The wine bottle positioning device according to claim 2, further comprising a torsion spring sleeved on the pivot portion, wherein the torsion spring comprises a first end and a second end opposite to the first end, the first end abuts against the cover portion, and the second end abuts against the positioning base.

4. The wine bottle positioning device according to claim 2, wherein the door cover further comprises a sensing portion connected to the cover portion.

5. The wine bottle positioning device according to claim 4, wherein the positioning base further comprises an open groove communicated with the first internal space, and the open groove is located on a moving path of the sensing portion.

6. The wine bottle positioning device according to claim 5, wherein the sensing portion is moved out of the first internal space through the open groove after the door cover is rotated relative to the positioning base to open the opening.

7. The wine bottle positioning device according to claim 5, wherein the positioning base further comprises a first surface and a second surface intersecting the first surface, the opening is located at the first surface, and the open groove is located at the second surface.

8. A wine bottle positioning device, comprising:

a sleeving component, comprising a positioning base and a positioning sleeve connected to the positioning base, wherein the positioning base comprises an opening and a first internal space communicated with the opening, the positioning sleeve comprises a second internal space communicated with the first internal space, the first internal space of the positioning base comprises a first depth axis, the second internal space of the positioning sleeve comprises a second depth axis, and an angle between the first depth axis and the second depth axis is ranged from 3 to 7 degrees; and an auxiliary positioning sleeve, disposed in the second internal space, wherein the auxiliary positioning sleeve comprises a third internal space, and the third internal space is communicated with the first internal space.

9. The wine bottle positioning device according to claim 8, wherein the positioning sleeve further comprises an inner wall surface surrounding the second internal space and a first positioning portion located on the inner wall surface.

10. The wine bottle positioning device according to claim 9, wherein the auxiliary positioning sleeve further comprises an outer wall surface facing away from the third internal space and a second positioning portion located on the outer wall surface.

11. The wine bottle positioning device according to claim 10, wherein the outer wall surface of the auxiliary positioning sleeve faces towards the inner wall surface of the positioning sleeve, and the second positioning portion is engaged with the first positioning portion.

12. The wine bottle positioning device according to claim 8, wherein the auxiliary positioning sleeve further comprises an inner wall surface surrounding the third internal space and a plurality of positioning fin sets connected to the inner wall surface.

13. The wine bottle positioning device according to claim 12, wherein the positioning fin sets are arranged alternately along a depth axis of the third internal space.

14. The wine bottle positioning device according to claim 12, wherein each of the plurality of positioning fin sets comprises at least two positioning fins.

15. The wine bottle positioning device according to claim 14, wherein each of the positioning fins comprises a convex curved surface connected to the inner wall surface and a concave curved surface facing away from the convex curved surface, and the two concave curved surfaces of the two positioning fins define a positioning channel.

16. The wine bottle positioning device according to claim 8, wherein the auxiliary positioning sleeve further comprises an inner wall surface surrounding the third internal space and a plurality of positioning fins connected to the inner wall surface.

17. The wine bottle positioning device according to claim 16, wherein the positioning fins are arranged alternately around a depth axis of the third internal space.

18. The wine bottle positioning device according to claim 16, wherein each of the positioning fins extends along a depth axis of the third internal space.

19. The wine bottle positioning device according to claim 16, wherein each of the positioning fins comprises a positioning surface facing away from the inner wall surface, and the positioning surfaces of the positioning fins define a positioning channel.

20. The wine bottle positioning device according to claim 19, wherein each of the positioning fins further comprises a first positioning end close to the opening and a second positioning end away from the opening.

21. The wine bottle positioning device according to claim 20, wherein a height of each positioning surface of each of the positioning fins gradually increases from the first positioning end to the second positioning end, and the height is defined from the inner wall surface of the auxiliary positioning sleeve.

22. The wine bottle positioning device according to claim 16, wherein each of the positioning fins is in a spiral shape.

23. The wine bottle positioning device according to claim 20, wherein the auxiliary positioning sleeve further comprises a plurality of auxiliary fins connected to the inner wall surface.

24. The wine bottle positioning device according to claim 23, wherein any two of the auxiliary fins adjacent to each other is separated by one of the positioning fins.

25. The wine bottle positioning device according to claim 23, wherein each of the auxiliary fins comprises an auxiliary surface facing away from the inner wall surface of the third internal space.

26. The wine bottle positioning device according to claim 25, wherein each of the auxiliary fins further comprises a first auxiliary end close to the opening and a second auxiliary end away from the opening.

27. The wine bottle positioning device according to claim 26, wherein a height of the auxiliary surface of each of the auxiliary fins gradually increases from the first auxiliary end to the second auxiliary end.

28. The wine bottle positioning device according to claim 27, wherein a height of the positioning surface of each of the positioning fins on the first positioning end is greater than a height of the auxiliary surface of each of the auxiliary fins on the first auxiliary end.

29. The wine bottle positioning device according to claim 27, wherein a height of the positioning surface of each of the positioning fins on the second positioning end is greater than a height of the auxiliary surface of each of the auxiliary fins on the second auxiliary end.

30. The wine bottle positioning device according to claim 23, wherein the third internal space of the auxiliary positioning sleeve is divided into an upper half space and a lower half space, the auxiliary fins are distributed in the upper half space, and the positioning fins are distributed in the upper half space and the lower half space.

31. The wine bottle positioning device according to claim 8, wherein the first internal space of the positioning base comprises a first depth axis, the second internal space of the positioning sleeve comprises a second depth axis, the third internal space of the auxiliary positioning sleeve comprises a third depth axis, and the second depth axis and the third depth axis are coaxial.

32. A wine storage apparatus, comprising:

a shelf; and a plurality of wine bottle positioning devices, integrated on the shelf, wherein each of the wine bottle positioning devices comprises a sleeving component, each of the sleeving components comprises a positioning base and a positioning sleeve connected to the positioning base and is configured to sheathe a bottleneck of an external wine bottle, and the positioning base of each of the sleeving components comprises an opening configured for inserting the bottleneck, wherein the positioning base comprises an opening and a first internal space communicated with the opening, the positioning sleeve comprises a second internal space communicated with the first internal space, the first internal space of the positioning base comprises a first depth axis, the second internal space of the positioning sleeve comprises a second depth axis, and an angle between the first depth axis and the second depth axis is ranged from 3 to 7 degrees.

33. A wine bottle positioning device, comprising:

a sleeving component, comprising a positioning base and a positioning sleeve connected to the positioning base, wherein the positioning base comprises an opening and a first internal space communicated with the opening, and the positioning sleeve comprises a second internal space communicated with the first internal space; and an auxiliary positioning sleeve, disposed in the second internal space, wherein the auxiliary positioning sleeve comprises a third internal space communicated with the first internal space, an inner wall surface surrounding the third internal space, a plurality of positioning fins connected to the inner wall surface, and a plurality of auxiliary fins connected to the inner wall surface, wherein each of the positioning fins comprises a positioning surface facing away from the inner wall surface, a first positioning end close to the opening and a second positioning end away from the opening, and the positioning surfaces of the positioning fins define a positioning channel.

* * * * *